US011678756B2

(12) United States Patent
Reinhart

(10) Patent No.: US 11,678,756 B2
(45) Date of Patent: Jun. 20, 2023

(54) HANGER APPARATUS

(71) Applicant: Kelsey Elizabeth Reinhart, Grand Haven, MI (US)

(72) Inventor: Kelsey Elizabeth Reinhart, Grand Haven, MI (US)

(73) Assignee: Kelsey Elizabeth Reinhart, Grand Haven, MI (US)

( * ) Notice: Subject to any disclaimer, the term of this patent is extended or adjusted under 35 U.S.C. 154(b) by 0 days.

(21) Appl. No.: 17/384,506

(22) Filed: Jul. 23, 2021

(65) Prior Publication Data

US 2022/0022676 A1 Jan. 27, 2022

Related U.S. Application Data

(60) Provisional application No. 63/056,825, filed on Jul. 27, 2020.

(51) Int. Cl.

| | |
|---|---|
| ***A47G 25/02*** | (2006.01) |
| ***A47G 25/16*** | (2006.01) |
| ***A47G 25/28*** | (2006.01) |
| ***A47G 25/34*** | (2006.01) |
| ***A47G 25/48*** | (2006.01) |

(52) U.S. Cl.

CPC ..... *A47G 25/02* (2013.01); *A47G 25/16* (2013.01); *A47G 25/28* (2013.01); *A47G 25/34* (2013.01); *A47G 25/48* (2013.01)

(58) Field of Classification Search

CPC ..... A47G 25/16; A47G 25/28; A47G 25/34; A47G 25/48; A47G 25/482; A47G 25/483; A47G 25/486

See application file for complete search history.

(56) References Cited

U.S. PATENT DOCUMENTS 941,115 A * 11/1909 Vanderford ..... A47G 25/442 223/90
1,237,347 A * 8/1917 Lipoti ..... A47G 25/486 223/93
2,122,305 A * 6/1938 Vecchio ..... A47G 25/483 223/91
2,424,280 A * 7/1947 Lurtz ..... A47G 25/486 223/91
2,481,206 A * 9/1949 Eaton ..... A47G 25/487 223/91
2,656,077 A * 10/1953 Gensky ..... A47G 25/487 223/91
2,958,447 A * 11/1960 Rouseau ..... A47G 25/24 223/69
3,049,272 A * 8/1962 Tufts ..... A47G 25/28 D6/319

(Continued)

FOREIGN PATENT DOCUMENTS

DE 368114 C * 10/1920

*Primary Examiner* — F Griffin Hall

(74) *Attorney, Agent, or Firm* — The Watson IP Group, PLC; Jovan N. Jovanovic

(57) ABSTRACT

A hanger apparatus is comprised of a hook portion, a hanging portion, a neck portion, and a clip. The hook portion supports the hanger apparatus while the hanger apparatus is being hung from a hanger apparatus support. The hanging portion hangs an item of clothing. The neck portion is coupled to the hook portion on a first end of the neck portion and the hanging portion on a second end of the neck portion. The clip is coupled to the neck portion.

9 Claims, 4 Drawing Sheets

(56) References Cited

U.S. PATENT DOCUMENTS

| | | | | | |
|---|---|---|---|---|---|
| 3,143,261 | A * | 8/1964 | Brooke | A47G 25/483 | 223/91 |
| 5,402,558 | A * | 4/1995 | Santapa | A47G 25/485 | 24/511 |
| 5,595,331 | A * | 1/1997 | Leistner | A47G 25/481 | 24/511 |
| 6,036,064 | A * | 3/2000 | Tawil | A47G 25/1407 | 223/88 |
| 9,314,124 | B2 * | 4/2016 | Barre | A47G 25/48 | |
| 2007/0068979 | A1 * | 3/2007 | Wu | A47G 25/18 | 223/85 |
| 2009/0078726 | A1 * | 3/2009 | Boulet | A47G 25/30 | 223/85 |
| 2010/0301075 | A1 * | 12/2010 | Fearon | A47G 25/483 | 223/91 |
| 2012/0080459 | A1 * | 4/2012 | Dy | A47G 25/10 | 223/91 |

* cited by examiner

HANGER APPARATUS

CROSS-REFERENCE TO RELATED APPLICATION

This application claims priority from U.S. Provisional Patent App. Ser. No. 63/056,825 filed Jul. 27, 2020, entitled "Hanger Apparatus" the entire specification of which is hereby incorporated by reference in its entirety.

BACKGROUND OF THE DISCLOSURE

1. Field of the Disclosure

This invention relates to devices used for hanging and displaying clothes.

The disclosure relates in general to a clothes hanger, and more particularly, to a hanger that facilitates keeping various pieces of a clothing outfit together so that they can be easily viewed and retrieved at once without the time-consuming procedure of searching through a closet to assemble an outfit.

2. Background Art

While clothes hangers have been used for a long time to hang and display clothes, they have a shortcoming in their ability to hold and display a number of clothes related to one outfit on a single hanger. Often parents may have numerous outfits for infants and toddlers, for example, that they, or other caregivers, would like to be able to view and select rapidly without having to search for different pieces. Unfortunately, the various available clothes hangers do not permit several pieces of an outfit to be easily hung together. For example, folding pants over the bottom rung of a clothes hanger does not work well for shorts, hats, socks, jewelry or other common parts of an infant's, young child's, older child's outfit. The same is true for adult clothing where there may be several associated pieces of an outfit.

Various "hacks" and modifications to a traditional clothes hanger have been attempted, but they have failed to provide a satisfactory solution. For example, some have tried to add clothespins or binder clips to a hanger. But, because these devices are not integrated with the hanger, they can fall off and pose a danger to any child who finds them on a closet floor, or the like. The present invention is designed to provide a simple way to hang clothing of various shapes and sizes together on one hanger.

SUMMARY OF THE DISCLOSURE

The disclosure is directed to a hanger apparatus that is comprised of a hook portion, a hanging portion, a neck portion, and a clip. The hook portion supports the hanger apparatus while the hanger apparatus is being hung from a hanger apparatus support. The hanging portion hangs an item of clothing. The neck portion is coupled to the hook portion on a first end of the neck portion and the hanging portion on a second end of the neck portion. The clip is coupled to the neck portion.

In at least one configuration, the neck portion includes a base member having a first opening disposed therethrough, the clip includes a clip member having a second opening therethrough, and a biasing member is disposed through the first and second openings of the base member and the clip member. The biasing member biases a second end of the clip member toward a second end of the base member.

In at least one configuration, the clip member includes a first plurality of ridges disposed proximate to the hanging portion and the base member includes a second plurality of ridges disposed proximate to the hanging portion.

In at least one configuration, the hook portion includes an elbow member including a first end coupled to the first end of the neck portion, a straight member including a first end coupled to a second end of the elbow member, and a semi-circle member including a first end coupled to the second end of the straight member.

In at least one configuration, a second end of the semi-circle member is rounded.

In at least one configuration, the elbow member, the straight member, and the semi-circle member form an opening through which the hanger apparatus support is disposed through to hang the hanger apparatus.

In at least one configuration, the hanger apparatus further comprises a plurality of reinforcing ribs disposed at locations where the hook portion is coupled to the clip and where the clip is coupled to the hanging portion.

In at least one configuration, the hanging portion includes a first, second, and third straight members, the first and second straight members being coupled at first ends thereof to the second end of the neck portion, the first and second straight members being coupled at second ends thereof to first and second elbows, the third straight member being coupled to the first and second elbows.

In at least one configuration, the hook portion and the hanging portion have a circular cross section.

In at least one configuration, the clip includes a first offset member coupled to a back surface thereof and the neck portion includes a second offset member coupled to a front surface thereof, the first offset member and the second offset member forming a support for a biasing member biasing a second end of the clip member toward a second end of a base member of the neck portion.

In at least one configuration, the hanger apparatus is comprised of at least one of a plastic, a metal, and a wood.

In at least one configuration, the hanging portion is triangular in shape.

BRIEF DESCRIPTION OF THE DRAWINGS

The disclosure will now be described with reference to the drawings wherein.

DETAILED DESCRIPTION OF THE DISCLOSURE

Figure 1:
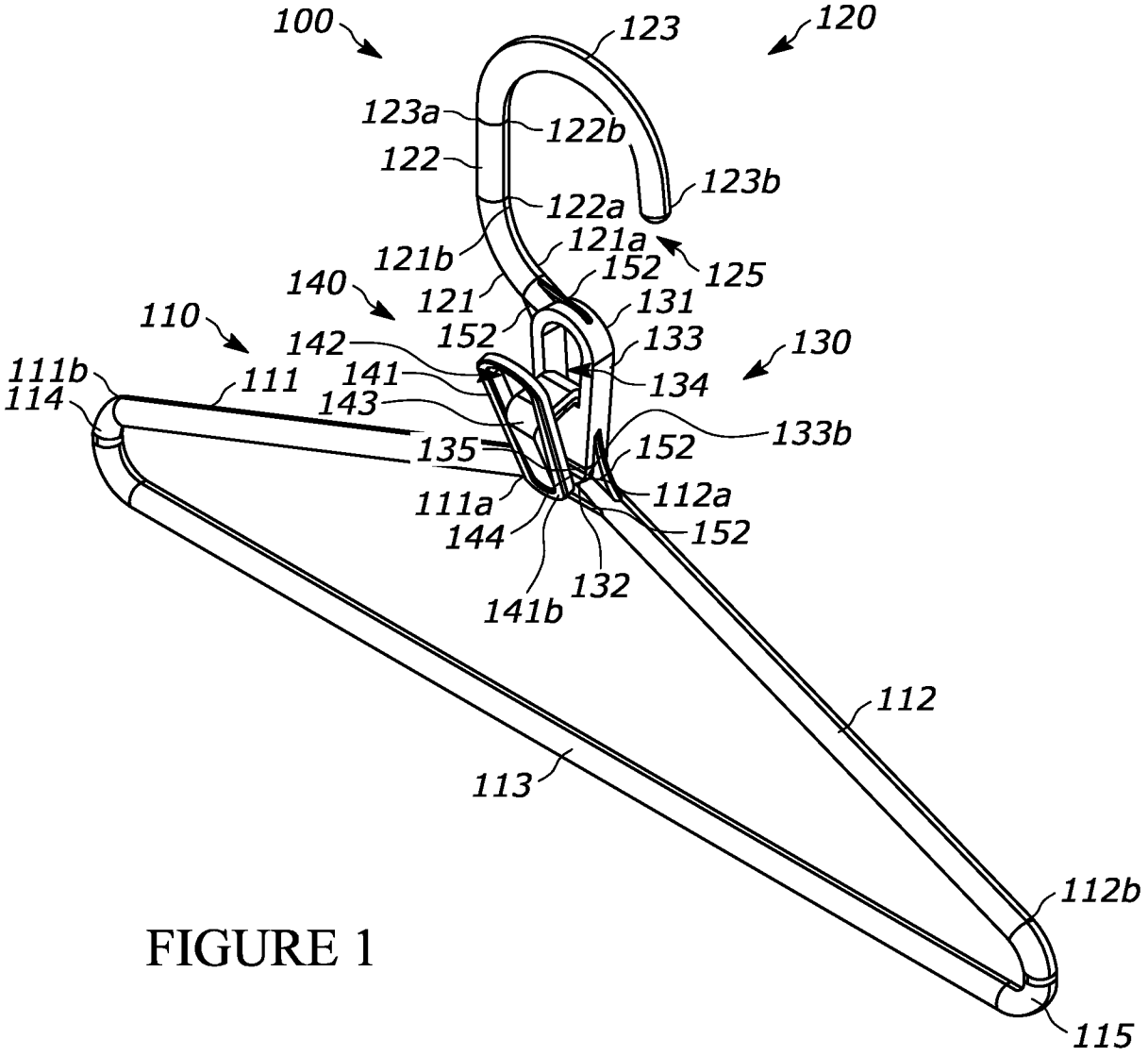
FIG. 1 illustrates an isometric view of an example hanger apparatus including an example integrated clamp mechanism, in accordance with at least one configuration disclosed herein.
Figure 2:
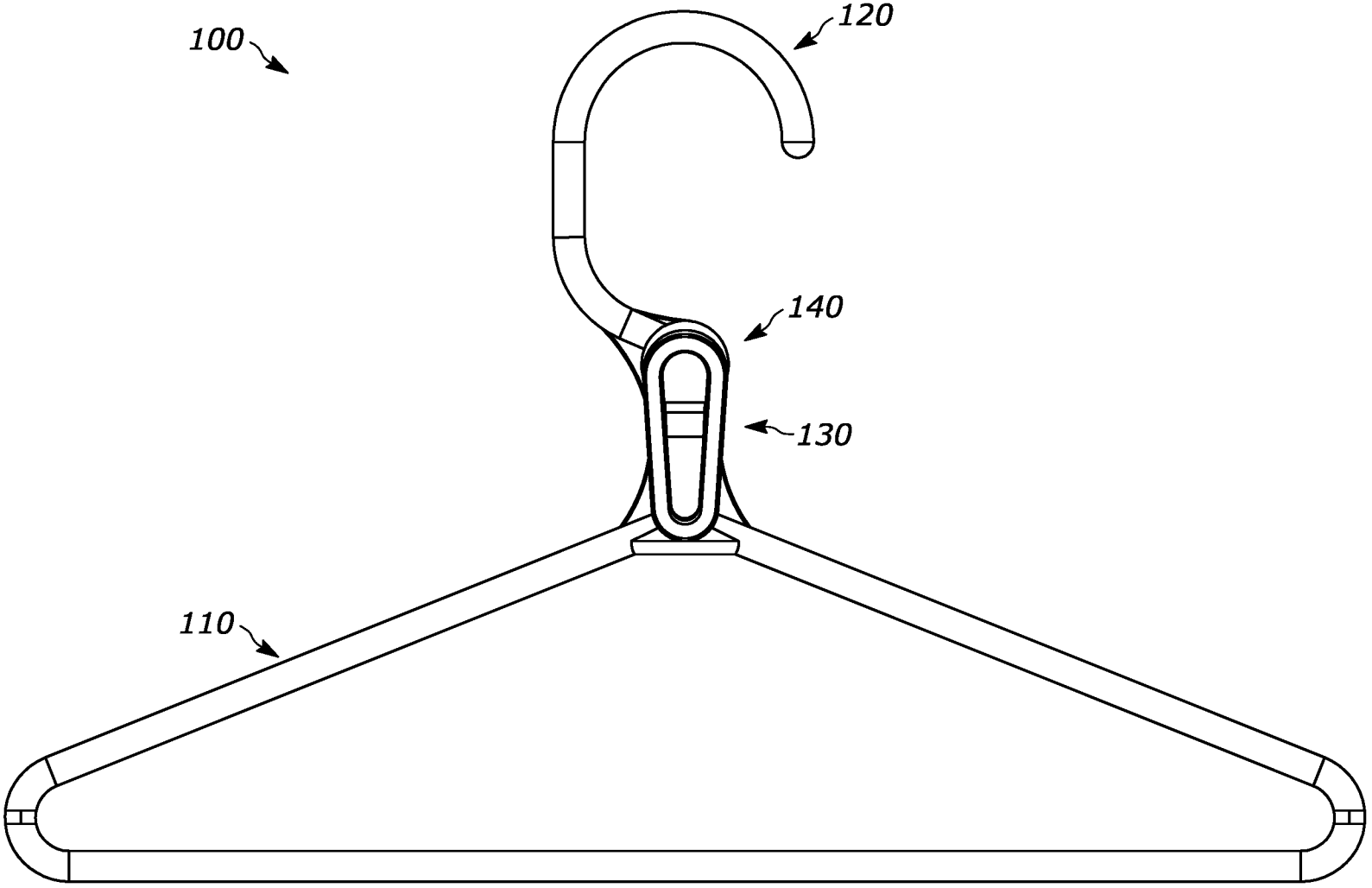
FIG. 2 illustrates a front view of the hanger apparatus including the integrated clamp mechanism shown in FIG. 1, in accordance with at least one configuration disclosed herein.
Figure 3:
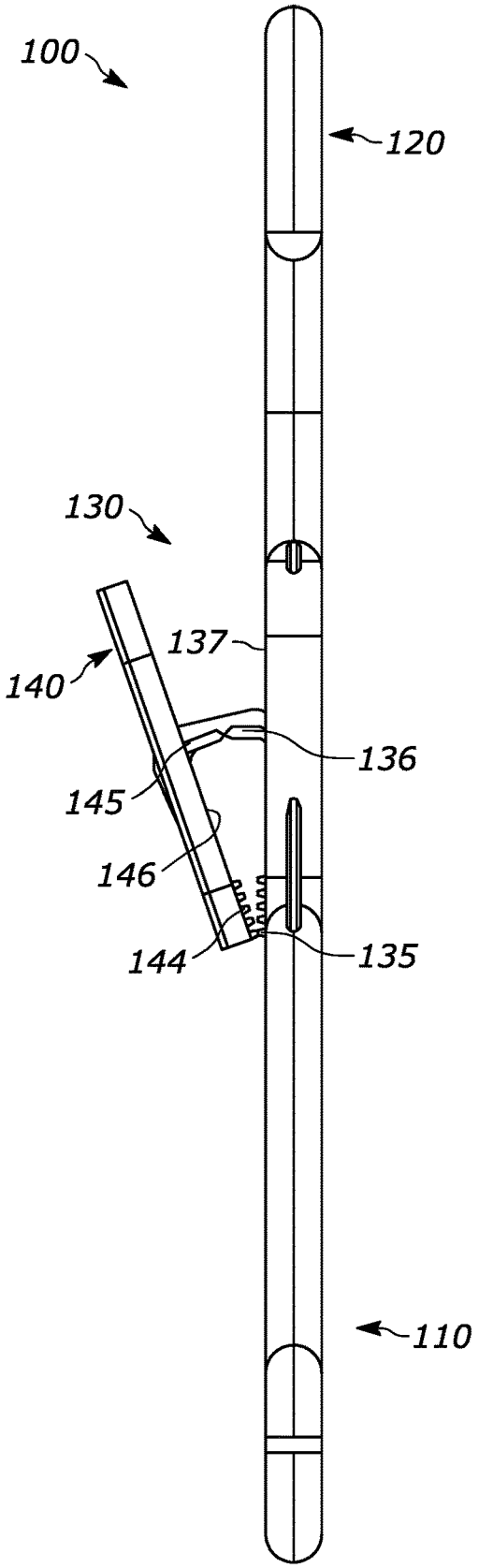
FIG. 3 illustrates a side view of the hanger apparatus including the integrated clamp mechanism shown in FIG. 1, in accordance with at least one configuration disclosed herein.
Figure 4:
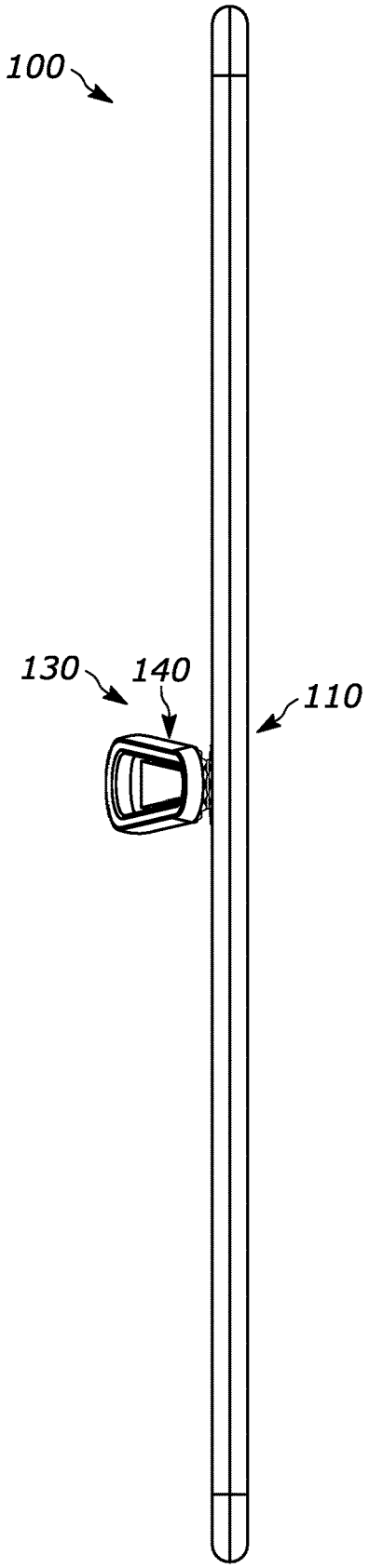
FIG. 4 illustrates a bottom view of the hanger apparatus including the integrated clamp mechanism shown in FIG. 1, in accordance with at least one configuration disclosed herein.

While this disclosure is susceptible of configuration in many different forms, there is shown in the drawings and described herein in detail a specific configuration(s) with the understanding that the present disclosure is to be considered as an exemplification and is not intended to be limited to the configuration(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1-5, shown is an apparatus, such as a hanger apparatus 100. The hanger apparatus 100 is comprised of a lower portion that includes a hanging portion 110 onto which various items of clothing or the like can be hung. The hanger apparatus 100 further includes an upper portion including a hook portion 120 to support the hanger apparatus 100 while the hanger apparatus 100 is being hung from a clothes rod or the like. The hanger apparatus 100 is further comprised of a neck portion 130 disposed between the hook portion 120 and the hanging portion 110, with a clip mechanism, such as clip 140, being coupled to this neck portion 130.

In at least one configuration, the hanging portion 110, the hook portion 120, and the neck portion 130 can be integrated, such as during a molding process during manufacture. In at least one configuration, the hanger apparatus 100 is comprised of at least one of a plastic, a metal, and a wood. Alternatively, the clip 140 can be attached to a hanger by gluing, thermo-welding, and/or mechanically fastening, without departing from the scope of these disclosures. It will be understood that the clip 140 can comprise a separate component and may be at least one of metal, wood, plastic, for example, and that the clip 140 can be attached in any one or more of the modes that is described. In at least one configuration, the hook portion 120 can be rotatably attached to the neck portion 130 so that the hanger apparatus 100 can be easily turned while still being hung. One skilled in the art would appreciate that the hanger apparatus 100 is only an example, and can be manufactured in a variety of sizes. For example, a version of the hanger apparatus 100 can use a smaller clip than that shown to hold associated items of doll clothing.

The clip 140 can be used to hang an additional object, such as clothing, from the hanger apparatus 100. Although the clip 140 can take various configurations, in at least one configuration the clip 140 includes a first offset member 145 (FIG. 3) coupled to a back surface 146 thereof. As shown, the first offset member 145 is disposed approximately centrally along the back surface 146 of the clip member 141. The neck portion 130 includes a second offset member 136 coupled to a front surface 137 thereof. The first offset member 145 and the second offset member 136 forming a support for a biasing member 143 that is disposed against the first and second offset members 145, 136. The biasing member 143 biases a second end 141*b* of the clip member 141 toward a second end 133*b* of a base member 133 of the neck portion 130.

In at least one configuration, a plurality of reinforcing ribs 152 can be disposed at locations where the hook portion 120 is coupled to the clip 140 and where the clip 140 is coupled to the hanging portion 110. These plurality of reinforcing ribs 152 at least mitigate flexure between the hook portion 120 and the clip 140 and between the clip 140 and the hanging portion 110, such as due to additional weight of an object being hung from the clip 140. In at least one configuration, the hook portion 120 and the hanging portion 110 have a circular cross section, as shown, although other cross sections are possible, such as triangular, square, rectangular, oval, or any other cross section.

Figure 5:
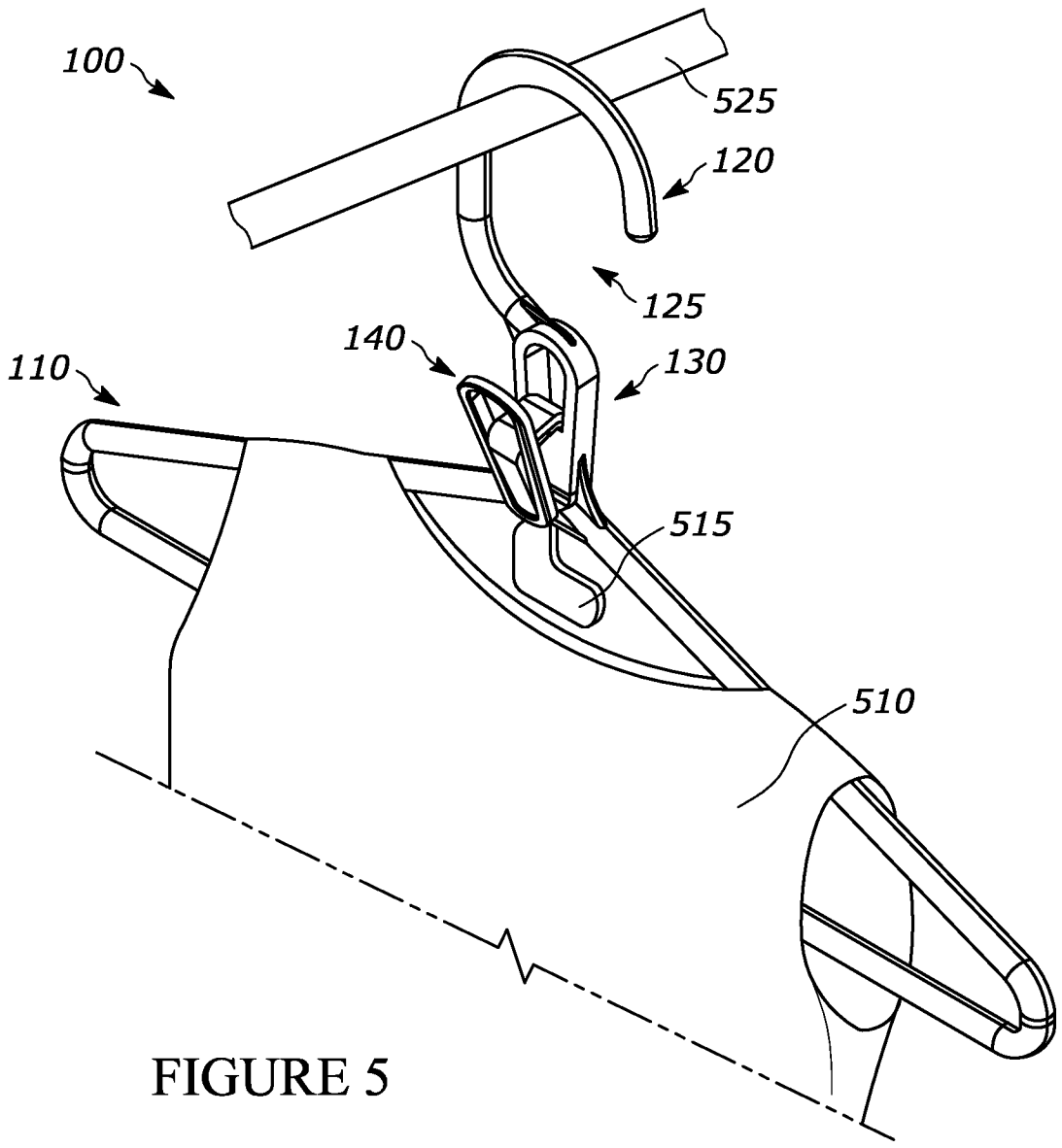
FIG. 5 illustrates an isometric view of the hanger apparatus including the integrated clamp mechanism shown in FIG. 1, with the hanger apparatus shown hanging clothing, in accordance with at least one configuration disclosed herein.

The hanging portion 110 is the portion of the hanger apparatus 100 that is used to hang an item of clothing 510 (FIG. 5). In at least one configuration the hanging portion 110 is triangular in shape. The hanging portion 110 can include a first, second, and third straight members 111, 112, 113. The first and second straight members 111, 112 are coupled at first ends thereof 111*a*, 112*a* to a second end 132 of the neck portion 130. The first and second straight members 111, 112 are coupled at second ends thereof 111*b*, 112*b* to first and second elbows 114, 115. The third straight member 113 is coupled to the first and second elbows 114, 115. This is just one example, with the hanging portion 110 in other configurations being rectangular in shape, oval in shape, or any other shape that allows the clothing 510 to be hung from the hanging portion 110. In other configurations, the hanging portion 110 can use members that are curved instead of the first, second, and third straight members 111, 112, 113.

The hook portion 120 supports the hanger apparatus 100 while the hanger apparatus 100 is being hung from a hanger apparatus support 525 (FIG. 5), such as a clothes rod or the like. In at least one configuration, the hook portion 120 includes an elbow member 121. The elbow member 121 includes a first end 121*a* coupled to a first end 131 of the neck portion 130. The elbow member 121 can further include a straight member 122 including a first end 122*a* coupled to a second end 121*b* of the elbow member 121. The elbow member 121 can even further include a semi-circle member 123 including a first end 123*a* coupled to the second end 122 of the straight member 122. In at least one configuration, a second end 123*b* of the semi-circle member 123 is rounded. In at least one configuration, the elbow member 121, the straight member 122 and the semi-circle member 122 form an opening 125 through which the hanger apparatus support 525 is disposed through to hang the hanger apparatus 100. In other configuration(s) (not shown), the hook portion 120 can be entirely enclosed such that the hanger apparatus 100 would not include an opening 125.

The neck portion 130 is coupled to the hook portion 120 on a first end 131 of the neck portion 130 and the hanging portion 110 on a second end 132 of the neck portion 130. The neck portion 130 can include a base member 133 having a first opening 134 disposed therethrough, the first opening 134 being disposed through an upper area of the base member 133. In the configuration shown, the base member 133 includes rounded ends, with the upper end being wider than a lower end of the base member 133. The clip 140 coupled to the neck portion 130. In at least one configuration, the clip 140 can include a clip member 141 having a second opening 142 therethrough. A biasing member 143 can be disposed through the first and second openings 134, 142 of the base member 133 and the clip member 141. The biasing member 143 biases a second end 141*b* of the clip member 141 toward a second end 133*b* of the base member 133. In at least one configuration, the clip member 141 includes a first plurality of ridges 144 disposed proximate to the hanging portion 110 and the base member 133 includes a second plurality of ridges 135 disposed proximate to the hanging portion 110. The first and second plurality of ridges 144, 135 at least mitigate an object, such as clothing, from slipping out of the clip 140.

In other configurations, two opposing sides, that is the base member 133 and the clip member 141, may include a live joint, so that they are co-molded and molded with portions of the hanger or separately. Furthermore, while a relatively narrow clip is shown, it will be understood that the clip may be wider or narrower, or that the clip may comprise two or more independent clips, or clips wherein there is one opposing side and two opposing sides that are attached thereto and that can be independently operated. Preferably, the clip is centrally located on the hanger apparatus 100.

In use of the hanger apparatus 100, items of clothing, such as shirts or dresses can be hung onto the hanging portion 110, as is done with a typical hanger, and shown in FIG. 5. Associated items or accessories can be attached to the hanger apparatus 100 by the clip 140 so that an entire outfit can be hung onto the hanger apparatus 100. In addition to facilitating the storage of outfits, the hanger apparatus 100 can be used to hang and keep other clothing 515, such as items of a team uniform, e.g., jersey, socks, shorts, and belt, together, or any other item, saving considerable time in hunting for parts of a uniform. A user would apply a squeezing force to the clip 140 and place the other clothing 515 within the clip 140 at the second end 141*b* thereof, and release the squeezing force to secure the other clothing 515 within the clip 140. The hanger apparatus 100 can then be hung from the hanger apparatus support 525.

Typical pants hangers do allow attachment of items (typically pants) from a bottom of the pants hanger via clips. But this location is difficult to view as typically another item of clothing, such as a shirt or jacket, is hung from the pants hanger which would cover the item of clothing hanging from the bottom of the pants hanger, also making hanging such item of clothing harder and more time consuming. The hanger apparatus 100 overcomes such deficiencies by locating the clip 140 above a bottom of the hanger apparatus 100, which facilitates easier viewing of the other clothing 515, and making it easier and less time consuming to hang the other clothing 515.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A hanger apparatus, comprising:

a hook portion to support the hanger apparatus while the hanger apparatus is being hung from a hanger apparatus support;

a hanging portion to hang an item of clothing;

a neck portion coupled to the hook portion on a first end of the neck portion and the hanging portion on a second end of the neck portion, wherein the neck portion defining a base member having a lower end having plurality of ridges extending outwardly therefrom, and an upper end, the upper end having a neck opening defined therethrough, the base member further having a second offset member extending outwardly therefrom between the opening and the plurality of ridges;

a clip having a back surface with a plurality of ridges at a lower end thereof, and an upper end, the upper end having a clip opening defined therethrough, and a first offset member extending outwardly from the back surface between the opening and the plurality of ridges, the first offset member and the second offset member engaging each other at a respective distal end thereof, with the plurality of ridges of the neck portion facing the plurality of ridges of the base portion; and a biasing member extending through the neck opening and through the clip opening so as to overlie a front surface of the clip and a back surface of the neck portion, the biasing member biasing the first offset member toward the second offset member, and directing the plurality of ridges of the neck portion and the plurality of ridges of the base portion toward each other into abutment, whereupon the biasing member is overcome by applying force to the upper end of the clip relative toward the neck portion, to, in turn, pivot the lower end of the clip from the lower end of the neck portion about the first and second offset members.

2. The hanger apparatus of claim 1, wherein the hook portion includes an elbow member including a first end coupled to the first end of the neck portion, a straight member including a first end coupled to a second end of the elbow member, and a semi-circle member including a first end coupled to the second end of the straight member.

3. The hanger apparatus of claim 2, therein a second end of the semi-circle member is rounded.

4. The hanger apparatus of claim 2, wherein the elbow member, the straight member, and the semi-circle member form an opening through which the hanger apparatus support is disposed through to hang the hanger apparatus.

5. The hanger apparatus of claim 1, further comprising a plurality of reinforcing ribs disposed at locations where the hook portion is coupled to the clip and where the clip is coupled to the hanging portion.

6. The hanger apparatus of claim 1, wherein the hanging portion includes a first, second, and third straight members, the first and second straight members being coupled at first ends thereof to the second end of the neck portion, the first and second straight members being coupled at second ends thereof to first and second elbows, the third straight member being coupled to the first and second elbows.

7. The hanger apparatus of claim 1, wherein the hook portion and the hanging portion have a circular cross section.

8. The hanger apparatus of claim 1, wherein the hanger apparatus is comprised of at least one of a plastic, a metal, and a wood.

9. The hanger apparatus of claim 1, wherein the hanging portion is triangular in shape.

* * * * *